US009441539B2

(12) United States Patent
Kim et al.

(10) Patent No.: US 9,441,539 B2
(45) Date of Patent: Sep. 13, 2016

(54) VARIABLE COMPRESSION RATIO APPARATUS

(71) Applicant: Hyundai Motor Company, Seoul (KR)

(72) Inventors: Won Gyu Kim, Seoul (KR); Myungsik Choi, Seoul (KR)

(73) Assignee: Hyundai Motor Company, Seoul (KR)

( * ) Notice: Subject to any disclaimer, the term of this patent is extended or adjusted under 35 U.S.C. 154(b) by 104 days.

(21) Appl. No.: 14/447,294

(22) Filed: Jul. 30, 2014

(65) Prior Publication Data

US 2015/0114356 A1 Apr. 30, 2015

(30) Foreign Application Priority Data

Oct. 30, 2013 (KR) ..... 10-2013-0129966

(51) Int. Cl.

| | |
|---|---|
| ***F01L 1/34*** | (2006.01) |
| ***F02B 75/04*** | (2006.01) |
| ***F02D 15/02*** | (2006.01) |
| ***F02D 15/04*** | (2006.01) |

(52) U.S. Cl.

CPC ..... *F02B 75/04* (2013.01); *F02B 75/042* (2013.01); *F02D 15/02* (2013.01); *F02D 15/04* (2013.01)

(58) Field of Classification Search

CPC ..... F02B 75/04; F02B 75/042; F02D 15/02; F02D 15/04

USPC ..... 123/78 AA, 48 A

See application file for complete search history.

(56) References Cited

U.S. PATENT DOCUMENTS

| | | | | |
|---|---|---|---|---|
| 3,970,056 | A * | 7/1976 | Morris | 123/48 D |
| 4,516,537 | A * | 5/1985 | Nakahara et al. | 123/48 AA |
| 4,987,863 | A * | 1/1991 | Daly | 123/48 AA |
| 6,450,154 | B1 * | 9/2002 | Choi | 123/536 |
| 6,708,655 | B2 * | 3/2004 | Maloney et al. | 123/48 A |
| 7,588,000 | B2 * | 9/2009 | Crower et al. | 123/48 AA |
| 2005/0241602 | A1 * | 11/2005 | Jiang | 123/90.17 |

FOREIGN PATENT DOCUMENTS

| | | |
|---|---|---|
| JP | 2007-113694 A | 5/2007 |
| KR | 10-0213545 B1 | 8/1999 |

* cited by examiner

*Primary Examiner* — Marguerite McMahon

(74) *Attorney, Agent, or Firm* — Morgan, Lewis & Bockius LLP

(57) ABSTRACT

A variable compression ratio apparatus may include an operating unit operated by hydraulic pressure to reciprocate the plunger, an oil control valve controlling hydraulic pressure supplied to the operating unit, an oil supplying unit storing oil supplied to the operating unit via the oil control valve and transmitting the stored oil to the oil control valve, an actuator operating the oil control valve, and a controller connected with the actuator to control the actuator according to an operational state of an engine.

17 Claims, 9 Drawing Sheets

VARIABLE COMPRESSION RATIO APPARATUS

CROSS-REFERENCE TO RELATED APPLICATION

The present application claims priority to and the benefit of Korean Patent Application No. 10-2013-0129966 filed on Oct. 30, 2013, the entire contents of which is incorporated herein for all purposes by this reference.

BACKGROUND OF THE INVENTION

1. Field of the Invention

The present invention relates to a variable compression ratio apparatus. More particularly, the present invention relates to a variable compression ratio apparatus which changes a volume of a combustion chamber such that a compression ratio is varied.

2. Description of Related Art

Generally, thermal efficiency of a heat engine is increased when a compression ratio is higher. Here, the compression ratio is a ratio of a volume of a gas which flows into a cylinder and is compressed by a piston, and is represented by "cylinder volume/combustion chamber volume at top dead center of a piston". That is, as the top dead center of the piston becomes higher, the compression ratio is increased.

In a case of a spark ignition engine, thermal efficiency may be increased by advancing ignition timing, but there may be a limitation in the advance of the ignition timing considering abnormal combustion and the like. Accordingly, a variable compression ratio (VCR) apparatus for improving thermal efficiency of the heat engine is demanded.

The variable compression ratio apparatus is an apparatus for changing a compression ratio of mixed gas according to an operational state of the engine. The variable compression ratio apparatus functions to improve fuel efficiency by improving a compression ratio of mixed gas under a low load condition of the engine, and prevent generation of knocking and improve output of an engine by decreasing the compression ratio of the mixed gas under a high load condition of the engine.

An ordinary variable compression ratio apparatus uses types that move a cylinder block, change a volume of a combustion chamber, and change a top dead center point of a piston.

However, many mechanical constituent elements are required and the composition thereof is too complex for realizing the ordinary variable compression ratio apparatus. In addition, fuel consumption may be deteriorated in a case that a motor using electric power is used so as to operate the mechanical constituent elements. Furthermore, a relatively strong driving torque is required for transferring power of a motor compared to other gear coupling. Therefore, it is limited that the capacity of the motor is reduced. Meanwhile, it is not easy to realize quick responsiveness of a variable compression ratio apparatus if the mechanical constituent elements are complexly connected.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio apparatus having an advantage of changing a compression ratio according to an operational state of an engine.

In addition, various aspects of the present invention are directed to providing a variable compression ratio apparatus having further advantage of improving fuel consumption and engine output by ensuring responsiveness.

A variable compression ratio apparatus according to an exemplary embodiment of the present invention changes a volume of a combustion chamber by an operation of a plunger disposed to be able to reciprocate in a space communicating with an interior of the combustion chamber according to an operational state of an engine. The apparatus may include an operating unit operated by hydraulic pressure so as to reciprocate the plunger, an oil control valve controlling hydraulic pressure supplied to the operating unit, an oil supplying unit storing oil supplied to the operating unit via the oil control valve, and transmitting the stored oil to the oil control valve, an actuator operating the oil control valve, and a controller connected with the actuator so as to control the actuator according to an operational state of the engine.

The operating unit may include a hydraulic pressure cylinder formed in a hollow cylindrical shape of which one surface and another surface are closed, a piston disposed to be able to reciprocate along a length direction of the hydraulic pressure cylinder in the hollow of the hydraulic pressure cylinder, and an operating rod integrally moving together with the piston and contacting the plunger, wherein the hollow of the hydraulic pressure cylinder may be partitioned into first chamber and second chamber by the piston.

The oil control valve may control hydraulic pressure such that oil is selectively supplied to the first chamber or the second chamber.

The operating rod moving together with the piston may push the plunger when oil is supplied to the first chamber such that the volume of the combustion chamber is decreased, and the operating rod moving together with the piston may pull the plunger when oil is supplied to the second chamber such that the volume of the combustion chamber is increased.

The oil control valve may include a valve body provided with a plurality of ports and a valve spool inserted into the valve body so as to be able to slide along a length direction of the valve body, the valve spool may include two lands fitted in an inner portion of the valve body and a spool shaft formed to be substantially thinner than the two lands and connecting the two lands to each other, and the plurality of ports may be respectively closed by one of the two lands or be respectively opened by communicating with a space in which the spool shaft is disposed.

The plurality of ports may include a supply port that is continuously opened and that communicates with the oil supplying unit so as to receive oil from the oil supplying unit, an outflow port that is continuously opened and that is formed to flow oil out from the valve body, a first inflow port that is selectively opened/closed by one of the two lands and that communicates with the first chamber so as to flow oil from the first chamber into the valve body, and a second inflow port that is selectively opened/closed by the other of the two lands and that communicates with the second chamber so as to flow oil from the second chamber into the valve body.

A hydraulic pressure line connected with the outflow port may be branched to two hydraulic pressure lines, and the two branched hydraulic pressure lines may be respectively connected to a hydraulic pressure line connecting the first chamber with the first inflow port and a hydraulic pressure line connecting the second chamber with the second inflow port.

A check valve may be disposed at each of the two branched hydraulic pressure lines, and the check valve may be opened so as to flow oil only from a hydraulic pressure line connected with the outflow port toward a hydraulic pressure line connecting the first chamber with the first inflow port or a hydraulic pressure line connecting the second chamber with the second inflow port.

The actuator may be a solenoid performing only an ON or OFF operation so as to operate the oil control valve in two stages.

The actuator may operate the oil control valve so as to realize a continuously varied compression ratio.

The a variable compression ratio apparatus may further include a position sensor detecting at least one position of the plunger, the piston, or the operating rod, and the controller may receive the detected position information from the position sensor and control the actuator according to the received position information.

The oil control valve may include a valve body provided with a plurality of ports and a valve spool inserted into the valve body so as to be able to slide along a length direction of the valve body, the valve spool may include two lands fitted in an inner portion of the valve body and a spool shaft formed to be substantially thinner than the two lands and connecting the two lands to each other, and the plurality of ports may be respectively closed by one of the two lands or may be respectively opened by communicating with a space in which the spool shaft is disposed.

The plurality of ports may include a supply port that is continuously opened and that communicates with the oil supplying unit so as to receive oil from the oil supplying unit, an outflow port continuously that is opened and that is formed to flow oil out from the valve body, a first inflow port that is selectively opened/closed by the one of the two lands and that communicates with the first chamber so as to flow oil from the first chamber into the valve body, and a second inflow port that is selectively opened/closed by the other one of the two lands and that communicates with the second chamber so as to flow oil from the second chamber into the valve body.

An opening amount of the first inflow port and the second inflow port may be duty-controlled as the valve spool is operated by the actuator operated according to position information of the plunger, the piston, or the operating rod.

A hydraulic pressure line connected with the outflow port may be branched to two hydraulic pressure lines, and the two branched hydraulic pressure lines may be respectively connected to a hydraulic pressure line connecting the first chamber with the first inflow port and a hydraulic pressure line connecting the second chamber with the second inflow port.

A check valve may be disposed at each one of the two branched hydraulic pressure lines, and the check valve may be opened so as to flow oil only from a hydraulic pressure line connected with the outflow port toward a hydraulic pressure line connecting the first chamber with the first inflow port or a hydraulic pressure line connecting the second chamber with the second inflow port.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
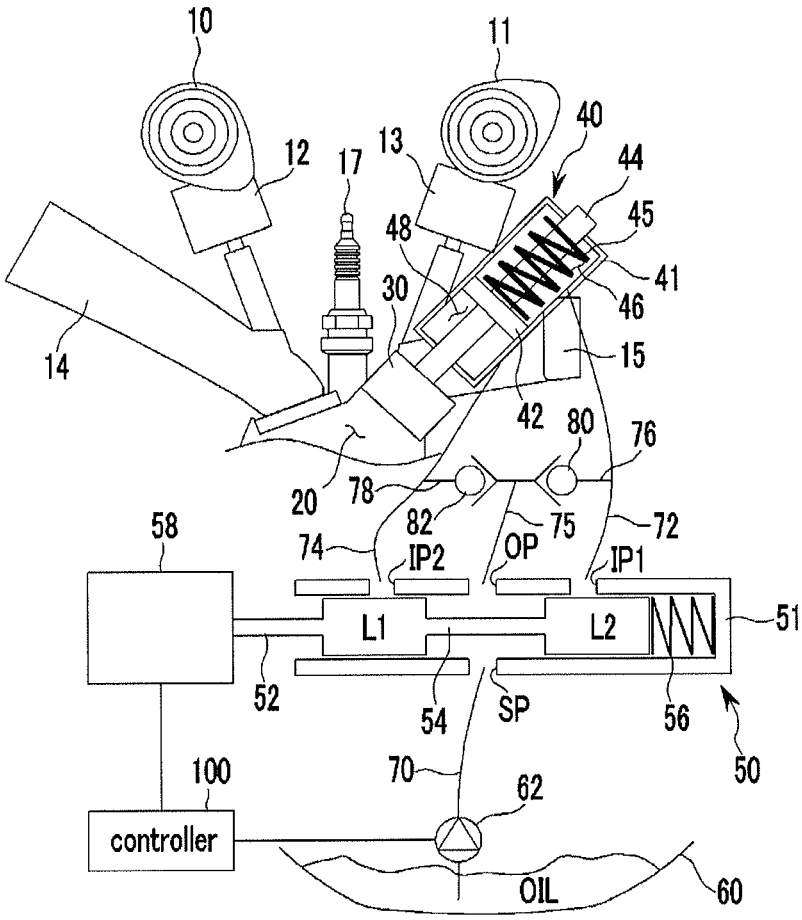
FIG. 1 is a schematic diagram of a variable compression ratio apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will be described in detail hereinafter with reference to the accompanying drawings.

FIG. 1 is a schematic diagram of a variable compression ratio apparatus according to an exemplary embodiment of the present invention.

As shown in FIG. 1, a variable compression ratio apparatus according to an exemplary embodiment of the present invention includes a plunger 30, an operating unit 40, an oil control valve 50, an oil pan 60, hydraulic pressure lines 70, 72, 74, 75, 76, and 78, and a controller 100.

The plunger 30 is provided to a cylinder head at which an intake valve opening/closing unit 12, an exhaust valve opening/closing unit 13, an intake passage 14, an exhaust passage 15, and a spark plug 17 are disposed.

One end of the intake valve opening/closing unit 12 is disposed at the intake passage 14 and connected to an intake valve so as to open/close an intake port communicated with a combustion chamber 20. In addition, the other end of the intake valve opening/closing unit 12 is rolling-contacted with an intake cam 10 such that the intake valve opening/closing unit 12 is operated by rotation of the intake cam 10.

One end of the exhaust valve opening/closing unit 13 is disposed at the exhaust passage 15 and connected to an exhaust valve so as to open/close an exhaust port communicated with the combustion chamber 20. In addition, the other end of the exhaust valve opening/closing unit 13 is rolling-contacted with an exhaust cam 11 such that the exhaust valve opening/closing unit 13 is operated by rotation of the exhaust cam 11.

The construction of the intake cam 10, the exhaust cam 11, the intake valve opening/closing unit 12, the exhaust valve opening/closing unit 13, the intake passage 14, the exhaust passage 15, and the spark plug 17 are well-known to a person of ordinary skill in the art, so a detailed description thereof will be omitted.

The plunger 30 is disposed to be able to reciprocate in a space communicating with an inner portion of the combustion chamber 20. In addition, a volume of the combustion chamber 20 is decreased when the plunger 30 is moved in a direction toward the combustion chamber 20, and a volume of the combustion chamber 20 is increased when the plunger 30 is moved in the opposite direction. Therefore, the compression ratio of an engine can be varied according to the reciprocal motion of the plunger 30. Herein, a forward direction will be defined as the direction that the plunger 30 is moved toward the combustion chamber 20, and a reverse direction will be defined as the opposite direction.

The operating unit 40 is connected with the plunger 30, and selectively moves the plunger 30 in the forward direction or the reverse direction. The operating unit 40 includes a hydraulic pressure cylinder 41, a piston 42, and an operating rod 44.

The hydraulic pressure cylinder 41 is formed in a hollow cylindrical shape such that one surface and another surface thereof are closed.

The piston 42 is formed in a cylindrical shape, and is disposed in the hollow area of the hydraulic pressure cylinder 41. In addition, the piston 42 is disposed to be able to reciprocate along a length direction of the hydraulic pressure cylinder 41. Further, the diameter of the piston 42 is formed with a size corresponding to the diameter of the hydraulic pressure cylinder 41 such that an exterior circumference of the piston 42 contacts an interior circumference of the hydraulic pressure cylinder 41. Therefore, the hollow are of the hydraulic pressure cylinder 41 is partitioned into two spaces by the piston 42.

One of the two spaces formed between one surface of the hydraulic pressure cylinder 41 and one surface of the piston 42 is a first chamber 46, and the other space of the two spaces formed between the other surface of the hydraulic pressure cylinder 41 and the other surface of the piston 42 is a second chamber 48.

The operating rod 44 is formed with a bar shape which is extended along one direction. In addition, the operating rod 44 is disposed so as to penetrate the one surface of the hydraulic pressure cylinder 41, the one surface of the piston 42, the other surface of the piston 42, and the other surface the hydraulic pressure cylinder 41 along the length direction thereof. Meanwhile, air-tightness is ensured between the operating rod 44 and the one surface of the hydraulic pressure cylinder 41, the one surface of the piston 42, the other surface of the piston 42, and the other surface of the hydraulic pressure cylinder 41 penetrated by the operating rod 44. Further, the operating rod 44 is adapted to be integrally formed or to move together with the piston 42.

Herein, one end of the operating rod 44 penetrates the one surface of the hydraulic pressure cylinder 41 so as to be positioned outside of the hydraulic pressure cylinder 41, and the other end of the operating rod 44 penetrates the other surface of the hydraulic pressure cylinder 41 so as to be positioned outside of the hydraulic pressure cylinder 41. In addition, the other end of the operating rod 44 penetrating the other end of the hydraulic pressure cylinder 41 is connected with the plunger 30. Therefore, the piston 42, the operating rod 44, and the plunger 30 are moved together.

The operating unit 40 further includes a spring 45.

One end of the spring 45 is fixed to the one surface of the hydraulic pressure cylinder 41, and the other end of the spring 45 is fixed to the one surface of the piston 42. In addition, the spring 45 prevents the piston 42 from excessively moving in the forward direction or the reverse direction.

The oil control valve 50 controls oil flow such that oil is selectively supplied into the first chamber 46 or the second chamber 48 of the operating unit 40. In addition, the oil control valve 50 includes a valve body 51 and a valve spool 52.

A plurality of ports SP, IP1, IP2, and OP are formed at the valve body 51. In addition, the plurality of ports SP, IP1, IP2, and OP are formed to penetrate the valve body 51 such that the inside and outside of the valve body 51 communicate with each other. Further, one end of the valve body 51 in a length direction thereof is opened, and the other end of the valve body 51 in a length direction thereof is closed.

The valve spool 52 is inserted into the valve body 51 so as to be able to slide along the length direction of the valve body 51. In addition, the valve spool 52 includes a first land L1 and a second land L2 fitted in an inner portion of the valve body 51. Further, the valve spool 52 includes a spool shaft 54 formed to be substantially thinner than the first and second lands L1 and L2 and connecting the first land L1 with the second land L2.

The oil control valve 50 further includes a solenoid 58 and a return spring 56.

The solenoid 58 is connected to one end of the valve spool 52. In addition, the one end of the valve spool 52 is extended from one surface of the first land L1, and is connected with the solenoid 58 through an opened end of the valve body 51. Further, the valve spool 52 is slid in one direction or the other direction along the length direction of the valve body 51 by operation of the solenoid 58. Meanwhile, the spool shaft 54 connects the other surface of the first land L1 with one surface of the second land L2. That is, the solenoid 58 performs a function of an actuator which operates the oil control valve 50. Herein, the actuator is not limited to the solenoid 58, and can be varied according to design by a person of ordinary skill in the art.

The return spring 56 is disposed between the other end of the valve spool 52 and the closed other end of the valve body 51. That is, the return spring 56 is disposed between the other surface of the second land L2 and the other end of the valve body 51. In addition, one end of the return spring 56 is fixed to the other surface of the second land L2, and the other end of the return spring 56 is fixed to the other end of the valve body 51. Further, the return spring 56 performs a function such that the valve spool 52 is returned to its original position in a case that the solenoid 58 is not operated to slide the valve spool 52 in one direction or the other direction.

The oil pan 60 stores oil supplied to the first chamber 46 or the second chamber 48 of the operating unit 40 through the oil control valve 50.

The hydraulic pressure lines 70, 72, 74, 75, 76, and 78 include a first hydraulic pressure line 70, a second hydraulic pressure line 72, a third hydraulic pressure line 74, a fourth hydraulic pressure line 75, a fifth hydraulic pressure line 76, and a sixth hydraulic pressure line 78. In addition, a plurality of ports SP, IP1, IP2, and OP provided to the valve body 51 include a supply port SP, a first inflow port IP1, a second inflow port IP2, and an outflow port OP.

The first hydraulic pressure line 70 communicates the oil pan 60 with the supply port SP. In addition, a hydraulic pump 62 is disposed on the first hydraulic pressure line 70, and oil pumped from the oil pan 60 by operation of the hydraulic pump 62 is supplied to the inside of the valve body 51 through the first hydraulic pressure line 70 and the supply port SP.

The second hydraulic pressure line 72 communicates the first inflow port IP1 with the first chamber 46. In addition, oil used for operation of the operating unit 40 in the first chamber 46 can flow to the inside of the valve body 51 from the first chamber 46 through the second hydraulic pressure line 72 and the first inflow port IP1.

The third hydraulic pressure line 74 communicates the second inflow port IP2 with the second chamber 48. In addition, oil used for operation of the operating unit 40 in the second chamber 48 can flow to the inside of the valve body 51 from the second chamber 48 through the third hydraulic pressure line 74 and the second inflow port IP2.

The fourth hydraulic pressure line 75 is communicated with the outflow port OP. In addition, the fourth hydraulic pressure line 75 extended from the outflow port OP is branched to the fifth hydraulic pressure line 76 and the sixth hydraulic pressure line 78.

The fifth hydraulic pressure line 76 is connected to the second hydraulic pressure line 72. In addition, the sixth hydraulic pressure line 78 is connected to the third hydraulic pressure line 74.

A first check valve 80 is disposed in the fifth hydraulic pressure line 76, and is opened so as to move oil in only one direction from the fourth hydraulic pressure line 75 toward the second hydraulic pressure line 72 and is closed so as to prevent oil flow in the opposite direction. In addition, a second check valve 82 is disposed in the sixth hydraulic pressure line 78, and is opened so as to move oil in only one direction from the fourth hydraulic pressure line 75 toward the third hydraulic pressure line 74 and closed so as to prevent oil flow in the opposite direction.

Meanwhile, oil supplied from the oil pan 60 to the inside of the valve body 51, oil flowed from the first chamber 46 to the inside of the valve body 51, and oil flowed from the second chamber 48 to the inside of the valve body 51 flow out to the fourth hydraulic pressure line 75 through the outflow port OP. In addition, oil flowed out to the fourth hydraulic pressure line 75 may sequentially pass through the fifth hydraulic pressure line 76 and the second hydraulic pressure line 72 so as to be supplied to the first chamber 46, or may sequentially pass through the sixth hydraulic pressure line 78 and the third hydraulic pressure line 74 so as to be supplied to the second chamber 48.

The controller 100 is connected with the solenoid 100 and the engine. In addition, the controller 100 controls operation of the solenoid 100 such that the operating unit 40 is operated according to an operational state of the engine.

Figure 2:
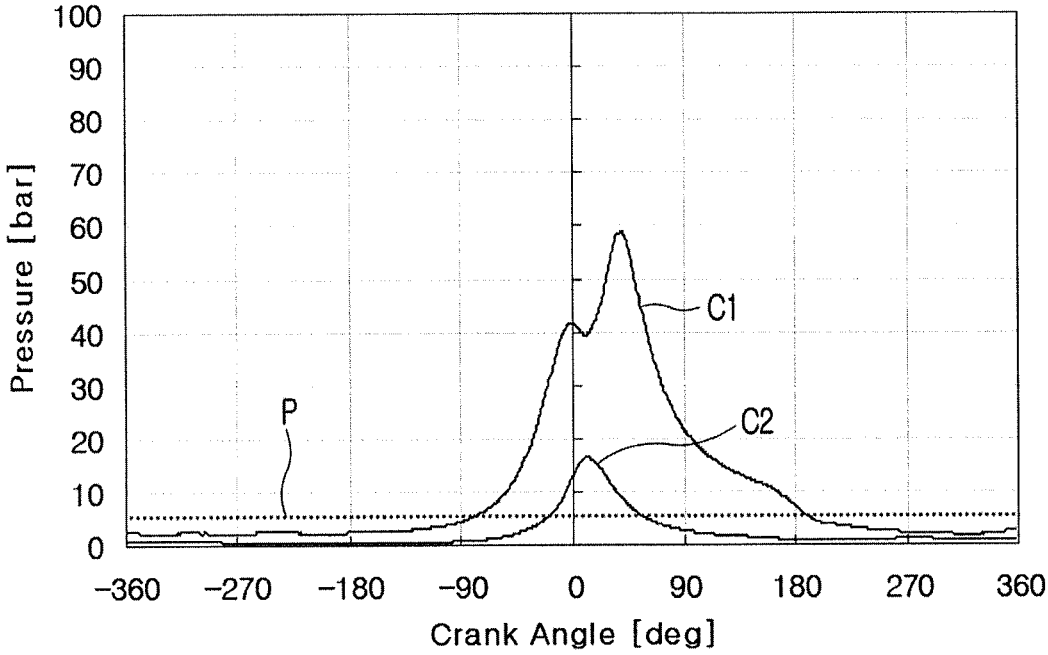
FIG. 2 is a graph illustrating pressure of a combustion chamber in a high load or low load situation of an engine.

FIG. 2 is a graph illustrating pressure of a combustion chamber in a high load or low load situation of an engine. In the graph of FIG. 2, a vertical axis represents pressure of the combustion chamber 20, and a horizontal axis represents rotation angle of a crankshaft.

As shown in FIG. 2, a high load pressure curve C1 to represent pressure of the combustion chamber 20 in a high load situation of an engine and a low load pressure curve C2 to represent pressure of the combustion chamber 20 in a low load situation of an engine respectively have a part where pressure is high and another part where pressure is low with respect to a predetermined pressure P. The predetermined pressure P may be set through experiments, and a preferably about 5 bar. However, the predetermined pressure P is not limited thereto, and can be variously predetermined by considering operation of the variable compression ratio apparatus and efficiency of an engine by a person of ordinary skill in the art. In addition, the predetermined pressure P is equal to the force that the spring 45 of the operating unit 40 exerts on the piston 42 in the forward direction. Hereinafter, the predetermined pressure P will be defined as a spring pressure P.

Referring to FIG. 3 to FIG. 8, operation of a variable compression ratio apparatus according to an exemplary embodiment of the present invention will be described in detail.

Figure 3:
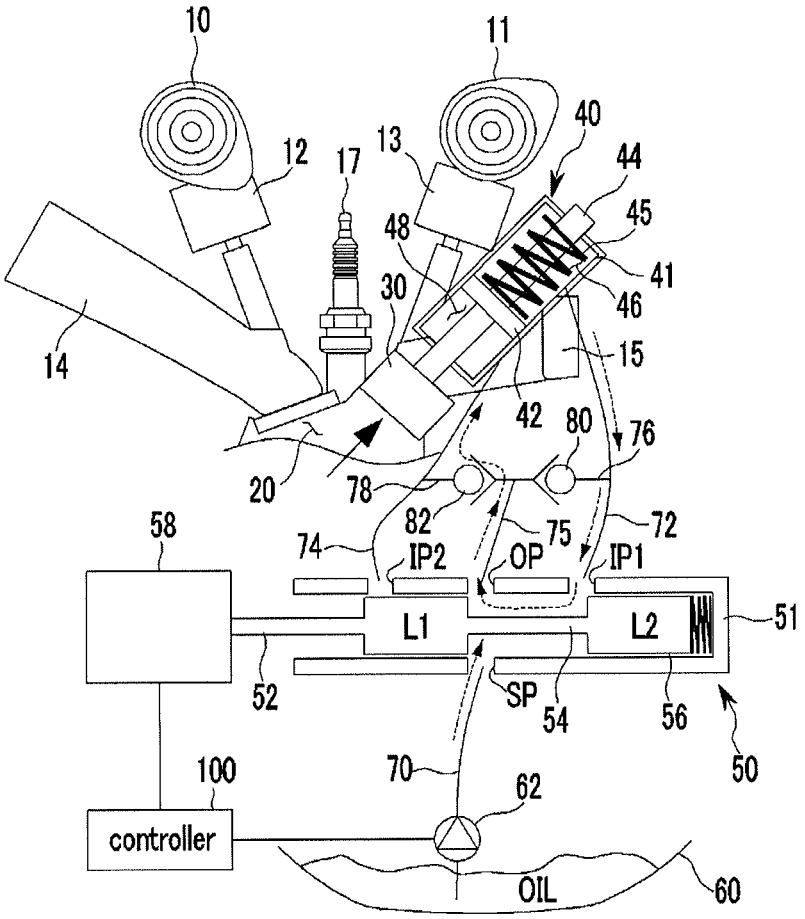
FIG. 3 is a diagram illustrating operation of a variable compression ratio apparatus according to an exemplary embodiment of the present invention for reducing the compression ratio.
Figure 4:
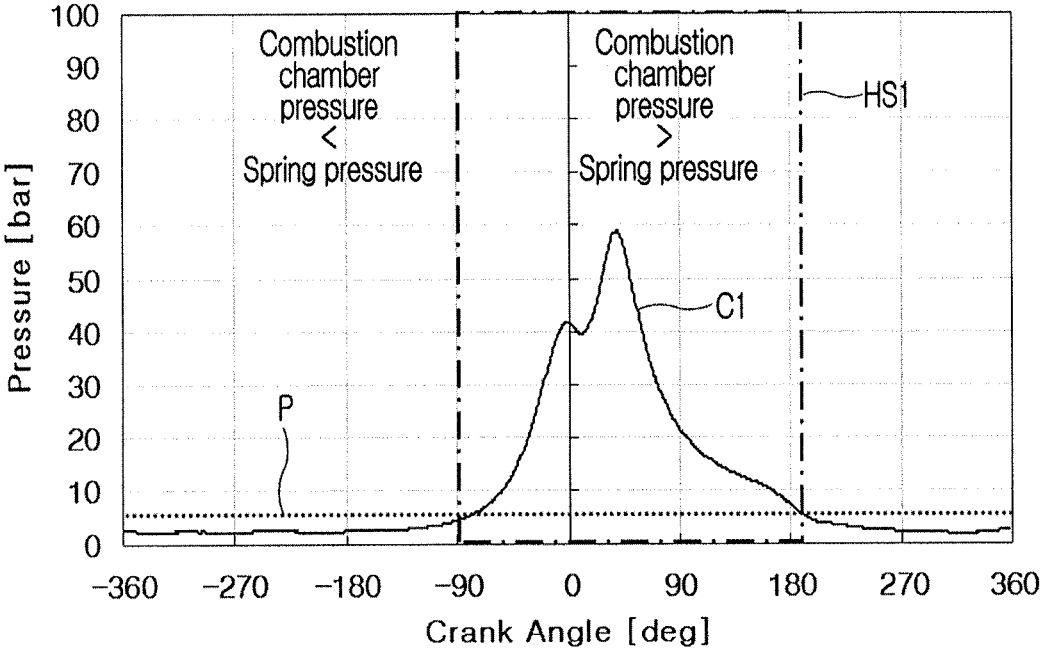
FIG. 4 is a graph illustrating a section where a variable compression ratio apparatus according to an exemplary embodiment of the present invention is operated so as to lower the compression ratio in a high load situation of an engine.
Figure 5:
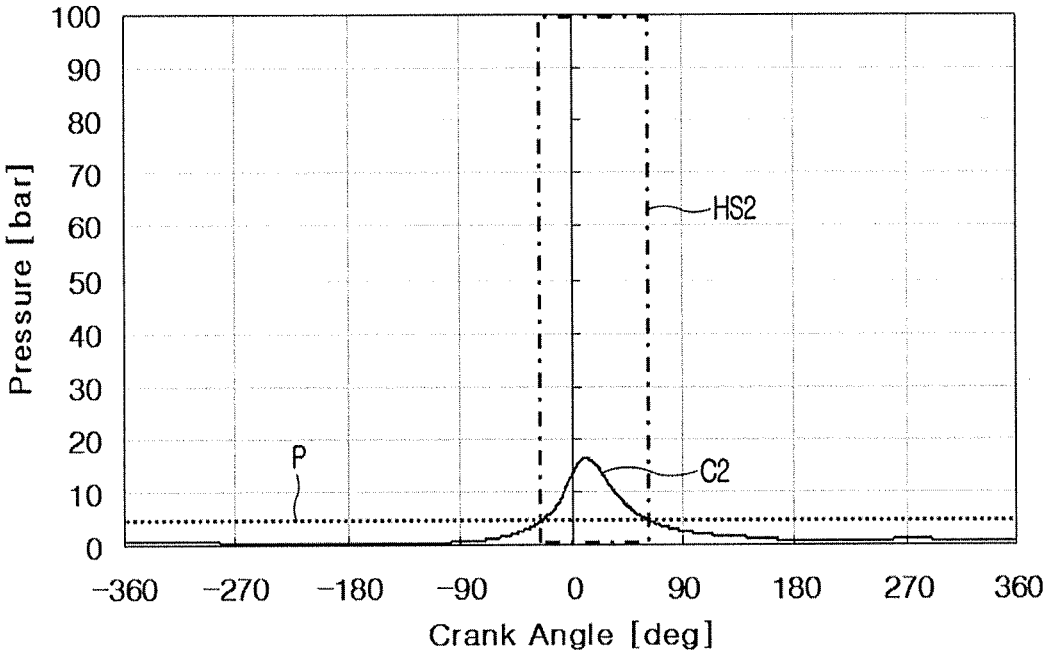
FIG. 5 is a graph illustrating a section where a variable compression ratio apparatus according to an exemplary embodiment of the present invention is operated so as to lower the compression ratio in a low load situation of an engine.

FIG. 3 is a diagram illustrating operation of a variable compression ratio apparatus according to an exemplary embodiment of the present invention for reducing the compression ratio, FIG. 4 is a graph illustrating a section where a variable compression ratio apparatus according to an exemplary embodiment of the present invention is operated so as to lower the compression ratio in a high load situation of an engine, and FIG. 5 is a graph illustrating a section where a variable compression ratio apparatus according to an exemplary embodiment of the present invention is operated so as to lower the compression ratio in a low load situation of an engine. Oil flow is indicated by dotted arrows in FIG. 3.

As shown in FIG. 3, the controller 100 operates the solenoid 58 so as to move the valve spool 52 toward the other end of the valve body 51 if the compression ratio of an engine is to be decreased. In addition, the space where the spool shaft 54 is disposed is positioned so as to communicate with the supply port SP, the first inflow port IP1, and the outflow port OP when the valve spool 52 is moved toward the other end of the valve body 51. That is, the supply port SP, the first inflow port IP1, and the outflow port OP are opened. At this time, the first land L1 is positioned so as to close the second inflow port IP2.

The hydraulic pump 62 is operated so as to supply oil from the oil pan 60 to the inside of the valve body 51 through the opened supply port SP.

The hydraulic pump 62 is operated by driving the crankshaft. In addition, when the hydraulic pump 62 is operated by driving the crankshaft, the hydraulic pump 62 supplies oil as much as a flow rate loss in the operating unit 40 through the oil control valve 50 without additional control. That is, the hydraulic pump 62 does not need to be controlled by the controller 100. Although FIG. 1, FIG. 3, FIG. 6, and FIG. 9 illustrate that the hydraulic pump 62 is connected to the controller 100, it is not limited thereto.

In this instance, the controller 100 is connected with the hydraulic pump 62. In addition, the controller 100 connected with the hydraulic pump 62 controls the hydraulic pump 62 according to an operational state of the engine. When operation of the hydraulic pump 62 is controlled by the controller 100, the controller 100 operates the hydraulic pump 62 such that oil is supplied from the oil pan 60 to the inside of the valve body 51 through the opened supply port SP. Thus, oil consumed by operation of the operating unit 40 is supplied through the oil control valve 50.

The case that the compression ratio of an engine should be decreased is an operational state of the engine corresponding to the section HS1 in which pressure of the combustion chamber 20 is higher than the spring pressure P in a high load situation of the engine as shown in FIG. 4 or the section HS2 in which pressure of the combustion chamber 20 is higher than the spring pressure P in a low load situation of the engine as shown in FIG. 5.

The plunger 30 and the piston 42 are pushed in the reverse direction by pressure of the combustion chamber 20 when pressure of the combustion chamber 20 becomes higher than the spring pressure P. In addition, oil is moved from the first chamber 46 to the opened first inflow port IP1 through the second hydraulic pressure line 72 by pressure of the first chamber 46 pressurized by the piston 42. Thus, the first check valve 80 which is disposed at the fifth hydraulic pressure line 76 connected with the second hydraulic pressure line 72 is closed. Further, oil flowed into the valve body 51 through the first inflow port IP1 and oil supplied to the valve body 51 through the supply port SP flow out from the valve body 51 through the opened outflow port OP, and oil flowed out from the valve body 51 is sequentially passed through the fourth hydraulic pressure line 75, the sixth hydraulic pressure line 78, and the third hydraulic pressure line 74 and is supplied to the second chamber 48. The plunger 30 and the piston 42 are moved in the reverse direction by the operation.

At this time, the plunger 30 is pushed in the forward direction by pressure P of the spring 45 if pressure of the combustion chamber 20 becomes lower than the spring pressure P. However, the second check valve 82 is closed if oil attempts to pass through the third hydraulic pressure line 74 from the second chamber 48 by pressure of the second chamber 48. Meanwhile, the motion of the piston 42 in the forward direction is limited because the state that the second inflow port IP2 is closed is maintained.

Figure 6:
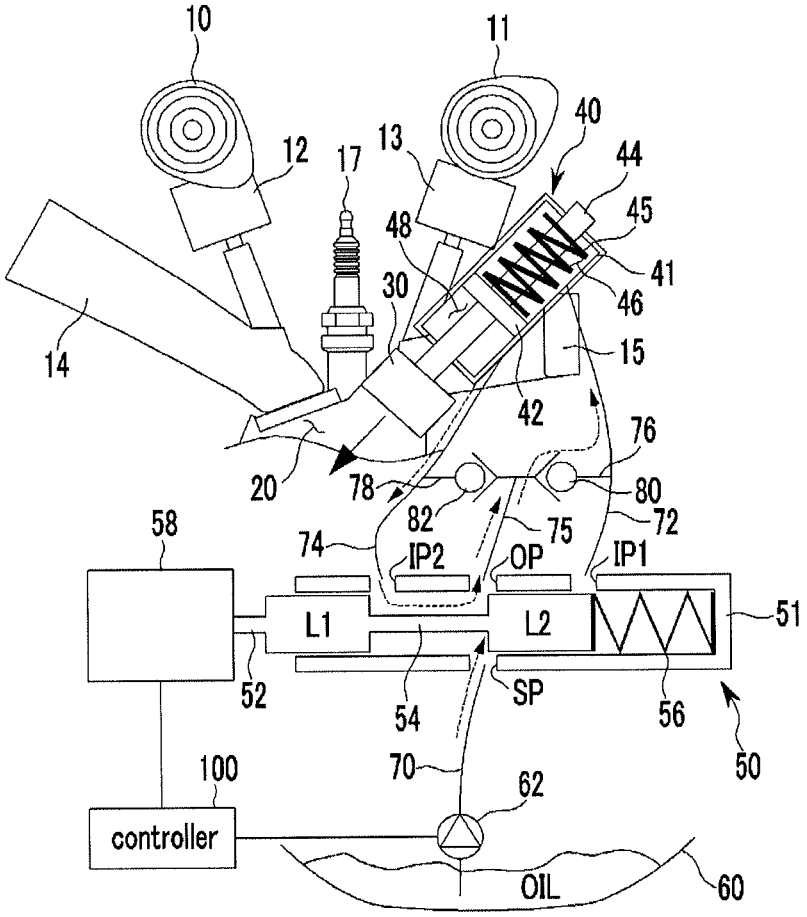
FIG. 6 is a diagram illustrating operation of a variable compression ratio apparatus according to an exemplary embodiment of the present invention for increasing the compression ratio.
Figure 7:
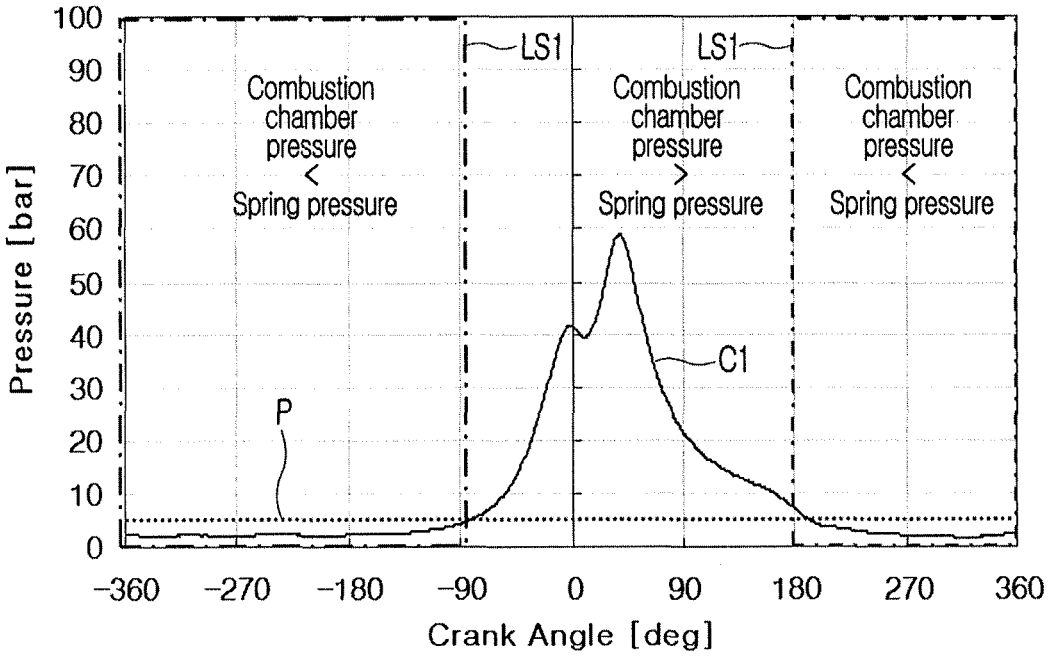
FIG. 7 is a graph illustrating a section where a variable compression ratio apparatus according to an exemplary embodiment of the present invention is operated so as to increase the compression ratio in a high load situation of an engine.
Figure 8:
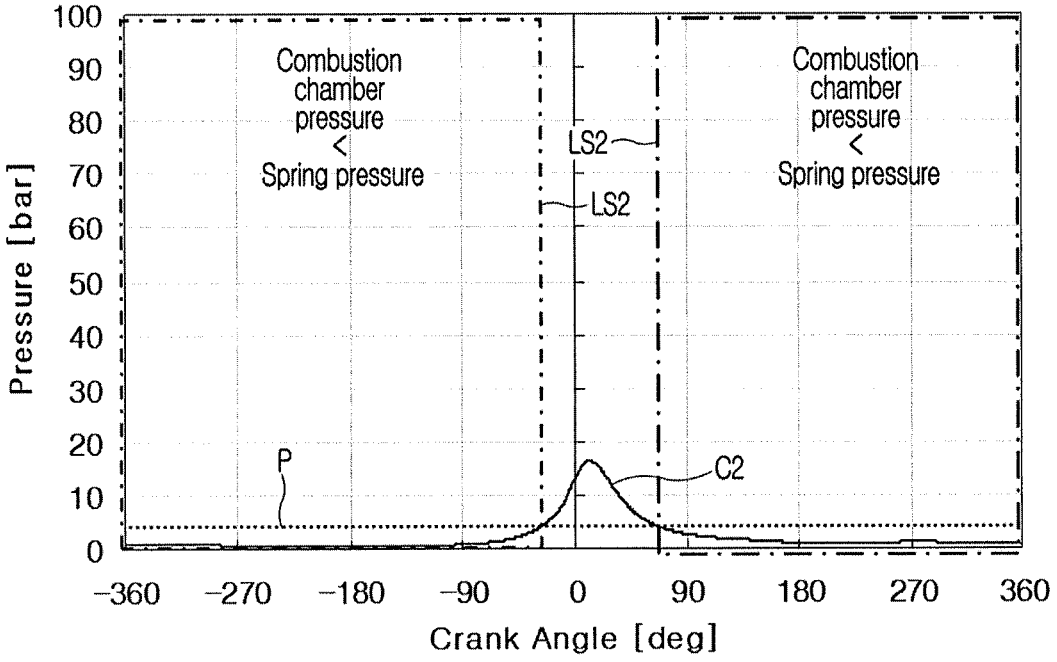
FIG. 8 is a graph illustrating a section where a variable compression ratio apparatus according to an exemplary embodiment of the present invention is operated so as to increase the compression ratio in a low load situation of an engine.

FIG. 6 is a diagram illustrating operation of a variable compression ratio apparatus according to an exemplary embodiment of the present invention for increasing the compression ratio, FIG. 7 is a graph illustrating a section where a variable compression ratio apparatus according to an exemplary embodiment of the present invention is operated so as to increase the compression ratio in a high load situation of an engine, and FIG. 8 is a graph illustrating a section where a variable compression ratio apparatus according to an exemplary embodiment of the present invention is operated so as to increase the compression ratio in low load situation of an engine. Oil flow is indicated by dotted arrows in FIG. 6.

As shown in FIG. 6, the controller 100 operates the solenoid 58 so as to move the valve spool 52 toward the one end of the valve body 51 if the compression ratio of an engine should be increased. In addition, the space where the spool shaft 54 is disposed is positioned so as to communicate with the supply port SP, the second inflow port IP2, and the outflow port OP when the valve spool 52 is moved toward the one end of the valve body 51. That is, the supply port SP, the second inflow port IP2, and the outflow port OP are opened. At this time, the second land L2 is positioned so as to close the first inflow port IP1.

Meanwhile, the controller 100 operates the hydraulic pump 62 such that oil is supplied from the oil pan 60 to the inside of the valve body 51 through the opened supply port SP. Therefore, oil consumed by operation of the operating unit 40 is supplied through the oil control valve 50.

The case that the compression ratio of an engine should be increased is an operational state of the engine corresponding to the section LS1 in which pressure of the combustion chamber 20 is lower than the spring pressure P in a high load situation of the engine as shown in FIG. 7 or the section LS2 in which pressure of the combustion chamber 20 is lower than the spring pressure P in a low load situation of the engine as shown in FIG. 8.

The plunger 30 and the piston 42 are pushed in the forward direction by pressure P of the spring 45 when pressure of the combustion chamber 20 becomes lower than the spring pressure P. In addition, oil is moved from the second chamber 48 to the opened second inflow port IP2 through the third hydraulic pressure line 74 by pressure of the second chamber 48 pressurized by the piston 42. Therefore, the second check valve 82 which is disposed at the sixth hydraulic pressure line 78 connected with the third hydraulic pressure line 74 is closed. Further, oil flowed into the valve body 51 through the second inflow port IP2 and oil supplied to the valve body 51 through the supply port SP flow out from the valve body 51 through the opened outflow port OP, and oil flowed out from the valve body 51 is sequentially passed through the fourth hydraulic pressure line 75, the fifth hydraulic pressure line 76, and the second hydraulic pressure line 72 so as to be supplied into the first chamber 46. The plunger 30 and the piston 42 are moved in the forward direction by the operation.

At this time, the plunger 30 is pushed in the reverse direction by pressure of the combustion chamber 20 if pressure of the combustion chamber 20 becomes higher than the spring pressure P. However, the first check valve 80 is closed if oil is moved to pass through the second hydraulic pressure line 72 from the first chamber 46 by pressure of the first chamber 46. Meanwhile, the motion of the piston 42 in the reverse direction is limited because the state that the first inflow port IP1 is closed is maintained.

The solenoid 58 is controlled by the controller 100 so as to perform ON or OFF operation of a variable compression ratio apparatus according to an exemplary embodiment of the present invention. Herein, the valve spool 52 is moved toward the one end of the valve body 51 by one operation of ON or OFF of the solenoid 58 such that the supply port SP, the second inflow port IP2, and the outflow port OP are opened and the first inflow port IP1 is closed. In addition, the valve spool 52 is moved toward the other end of the valve body 51 by the other operation of ON or OFF of the solenoid 58 such that the supply port SP, the first inflow port IP1, and the outflow port OP are opened and the second inflow port IP2 is closed. Meanwhile, an original position of the valve spool 52 is the position where the valve spool 52 is settled by elastic force of the return spring 56 when the solenoid 58 performs the OFF operation.

Figure 9:
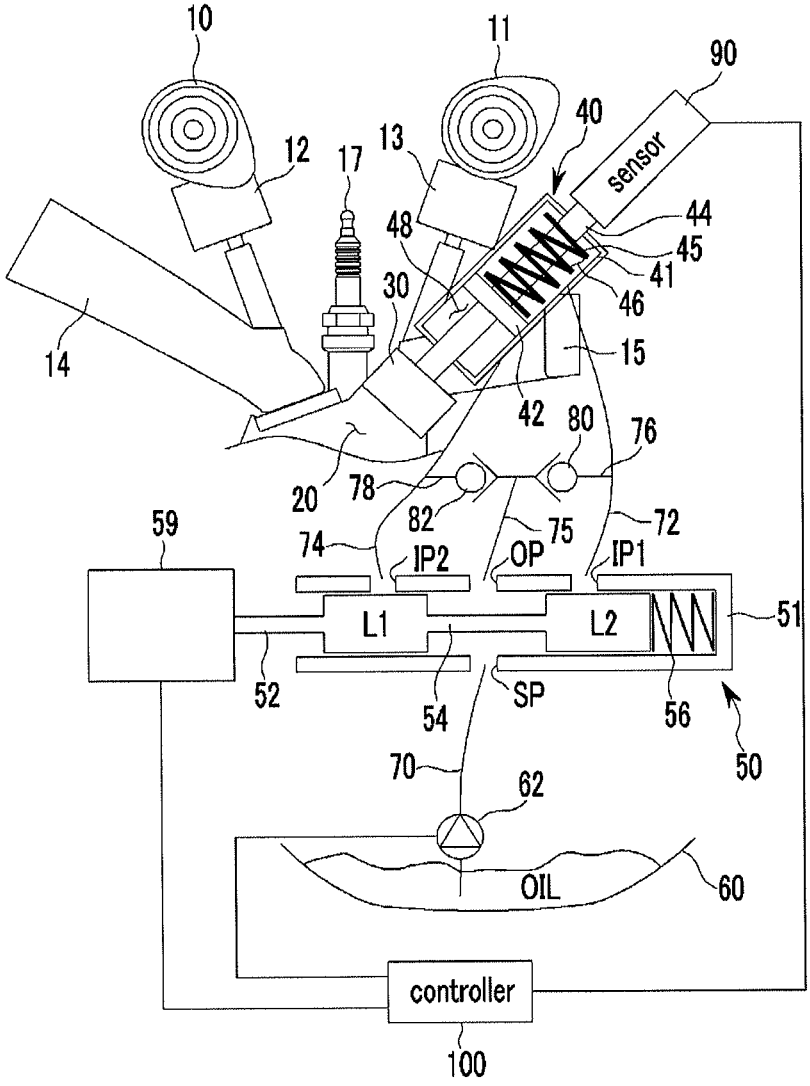
FIG. 9 is a schematic diagram of a variable compression ratio apparatus according to another exemplary embodiment of the present invention.

Referring to FIG. 9, a variable compression ratio apparatus according to another exemplary embodiment of the present invention will be described.

FIG. 9 is a schematic diagram of a variable compression ratio apparatus according to another exemplary embodiment of the present invention.

In the description regarding a variable compression ratio apparatus according to the current exemplary embodiment of the present invention which is illustrated in FIG. 9, repeated descriptions regarding the constituent elements that are the same as in a variable compression ratio apparatus according to a previous exemplary embodiment of the present invention will be omitted.

As shown in FIG. 9, a variable compression ratio apparatus according to the current exemplary embodiment of the present invention further includes a position sensor 90, unlike a variable compression ratio apparatus according to a previous exemplary embodiment of the present invention.

The position sensor 90 is disposed so as to detect at least one of a position of the plunger 30, the piston 42, or the operating rod 44. In addition, the position sensor 90 is connected with the controller 100 so as to transmit the detected position information to the controller 100.

Meanwhile, a solenoid 59 according to the current exemplary embodiment of the present invention duty-controls the oil control valve 50 by the position information transmitted from the position sensor 90 to the controller 100. In detail, the supply port SP and the outflow port OP are continuously opened not only in the current exemplary embodiment of the present invention but also in a previous exemplary embodiment of the present invention. Meanwhile, the solenoid 59 according to another exemplary embodiment of the present invention may control motion of the valve spool 52 such that the first land L1 and the second land L2 of the valve spool 52 respectively duty-control an opening amount of the second inflow port IP2 and the first inflow port IP1. Therefore, the compression ratio of the engine is controlled by stages in an exemplary embodiment of the present invention so as to be varied in two stages according to ON/OFF operation of the solenoid 58, but the compression ratio of the engine is controlled by sequences in another exemplary embodiment of the present invention so as to be continuously varied according to a high load or a low load of an engine.

According to an exemplary embodiment of the present invention, responsiveness in changing a compression ratio according to an operational state of the engine may be ensured, and fuel consumption and output of the engine may be improved. In addition, the manufacturing cost may be reduced as mechanical elements required for operating are removed. Further, durability may be improved by using hydraulic pressure.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio apparatus changing a volume of a combustion chamber by an operation of a plunger configured to reciprocate in a space communicating with an interior of the combustion chamber according to an operational state of an engine, the apparatus including:

an operating unit operated by hydraulic pressure to reciprocate the plunger, wherein the operating unit includes:

a hydraulic pressure cylinder formed in a hollow cylindrical shape of which a first surface and a second surface thereof are closed;

a piston reciprocating along a length direction of the hydraulic pressure cylinder in a hollow of the hydraulic pressure cylinder; and an operating rod passing through at least one of the first surface and the second surface of the hydraulic pressure cylinder and connected to the piston and the plunger, wherein the operating rod integrally moves together with the piston and the plunger, and wherein the hollow of the hydraulic pressure cylinder is partitioned into a first chamber and a second chamber by the piston, and wherein the operating rod moving together with the piston pushes the plunger when oil is supplied to the first chamber such that the volume of the combustion chamber is decreased, and the operating rod moving together with the piston pulls the plunger when the oil is supplied to the second chamber such that the volume of the combustion chamber is increased;

an oil control valve controlling the hydraulic pressure supplied to the operating unit, wherein the oil control valve controls hydraulic pressure such that the oil is selectively supplied to the first chamber or the second chamber;

an oil supplying unit storing oil supplied to the operating unit via the oil control valve, and transmitting the stored oil to the oil control valve;

an actuator operating the oil control valve; and a controller connected with the actuator to control the actuator according to the operational state of the engine.

2. The apparatus of claim 1, wherein the oil control valve includes a valve body provided with a plurality of ports and a valve spool inserted into the valve body to slide along a length direction of the valve body, wherein the valve spool includes:

two lands fitted in an inner portion of the valve body; and a spool shaft formed to be substantially thinner than the two lands and connecting the two lands with each other, and wherein the plurality of ports are respectively closed by a first of the two lands or are respectively opened by communicating with a space in which the spool shaft is disposed.

3. The apparatus of claim 2, wherein the plurality of ports include:

a supply port that is continuously open and that communicates with the oil supplying unit to receive the oil from the oil supplying unit;

an outflow port that is continuously open and that is formed to flow the oil out from the valve body;

a first inflow port that is selectively opened or closed by the first of the two lands and that communicates with the first chamber to flow the oil from the first chamber into the valve body; and a second inflow port selectively that is opened or closed by a second of the two lands and that communicates with the second chamber to flow the oil from the second chamber into the valve body.

4. The apparatus of claim 3, wherein a hydraulic pressure line connected with the outflow port is branched to two hydraulic pressure lines, and wherein the two branched hydraulic pressure lines are respectively connected to a hydraulic pressure line connecting the first chamber with the first inflow port and a hydraulic pressure line connecting the second chamber with the second inflow port.

5. The apparatus of claim 4, wherein a check valve is disposed at each of the two branched hydraulic pressure lines, and wherein the check valve is opened to flow the oil only from a hydraulic pressure line connected with the outflow port toward a hydraulic pressure line connecting the first chamber with the first inflow port or a hydraulic pressure line connecting the second chamber with the second inflow port.

6. The apparatus of claim 1, wherein the actuator is a solenoid performing only an ON or OFF operation to operate the oil control valve in two stages.

7. The apparatus of claim 1, wherein the actuator operates the oil control valve to realize a continuously varied compression ratio.

8. The apparatus of claim 1, further including a position sensor detecting at least one position of the plunger, the piston, or the operating rod, wherein the controller receives a detected position information from the position sensor and controls the actuator according to a received position information.

9. The apparatus of claim 8, wherein the oil control valve includes a valve body provided with a plurality of ports and a valve spool inserted into the valve body to slide along a length direction of the valve body, wherein the valve spool includes two lands fitted in an inner portion of the valve body and a spool shaft formed to be substantially thinner than the two lands and connecting the two lands to each other, and wherein the plurality of ports are respectively closed by a first of the two lands or are respectively opened by communicating with a space in which the spool shaft is disposed.

10. The apparatus of claim 9, wherein the plurality of ports includes:

a supply port that is continuously open and that communicates with the oil supplying unit to receive the oil from the oil supplying unit;

an outflow port that is continuously open and that is formed to flow the oil out from the valve body;

a first inflow port that is selectively opened or closed by the first of the two lands and communicated with the first chamber to flow oil from the first chamber into the valve body; and a second inflow port that is selectively opened or closed by a second of the two lands and communicated with the second chamber to flow oil from the second chamber into the valve body.

11. The apparatus of claim 10, wherein an opening amount of the first inflow port and the second inflow port is duty-controlled as the valve spool is operated by the actuator operated according to the detected position information of the plunger, the piston, or the operating rod.

12. The apparatus of claim 10, wherein a hydraulic pressure line connected with the outflow port is branched to two hydraulic pressure lines, and wherein the two branched hydraulic pressure lines are respectively connected to a hydraulic pressure line connecting the first chamber with the first inflow port and a hydraulic pressure line connecting the second chamber with the second inflow port.

13. The apparatus of claim 12, wherein a check valve is disposed at each of the two branched hydraulic pressure lines, and wherein the check valve is opened to flow oil only from a hydraulic pressure line connected with the outflow port toward a hydraulic pressure line connecting the first chamber with the first inflow port or a hydraulic pressure line connecting the second chamber with the second inflow port.

14. A variable compression ratio apparatus changing a volume of a combustion chamber by operating a plunger configured to reciprocate in a space communicating with an interior of the combustion chamber according to an operational state of an engine, the apparatus including:

an operating unit operated by hydraulic pressure to reciprocate the plunger;

wherein the operating unit includes:

a hydraulic pressure cylinder formed in a hollow cylindrical shape of which a first surface and a second surface thereof are closed;

a piston reciprocating along a length direction of the hydraulic pressure cylinder in a hollow of the hydraulic pressure cylinder; and an operating rod passing through at least one of the first surface and the second surface of the hydraulic pressure cylinder and connected to the piston and the plunger, wherein the operating rod integrally moves together with the piston and the plunger, and wherein the hollow of the hydraulic pressure cylinder is partitioned into a first chamber and a second chamber by the piston;

an oil control valve controlling the hydraulic pressure supplied to the operating unit;

an oil supplying unit storing oil supplied to the operating unit via the oil control valve;

and transmitting the stored oil to the oil control valve;

an actuator operating the oil control valve;

a controller connected with the actuator to control the actuator according to the operational state of the engine; and a position sensor detecting at least one position of the plunger, the piston, or the operating rod, wherein the controller receives a detected position information from the position sensor and controls the actuator according to a received position information.

15. The apparatus of claim 14, wherein the oil control valve includes a valve body provided with a plurality of ports and a valve spool inserted into the valve body configured to slide along a length direction of the valve body, wherein the valve spool includes two lands fitted in an inner portion of the valve body and a spool shaft substantially thinner than the two lands and connecting the two lands to each other, and wherein the plurality of ports are respectively closed by a first of the two lands or are respectively opened by communicating with a space in which the spool shaft is disposed.

16. The apparatus of claim 15, wherein the plurality of ports includes:

a supply port that is continuously open and communicates with the oil supplying unit to receive the oil from the oil supplying unit;

an outflow port that is continuously open and that is formed to flow the oil out from the valve body;

a first inflow port that is selectively opened or closed by the first of the two lands and communicated with the first chamber to flow oil from the first chamber into the valve body; and a second inflow port that is selectively opened or closed by a second of the two lands and communicated with the second chamber to flow oil from the second chamber into the valve body.

17. The apparatus of claim 16, wherein an opening amount of the first inflow port and the second inflow port is duty-controlled as the valve spool is operated by the actuator operated according to the detected position information of the plunger, the piston, or the operating rod.

* * * * *